US010214023B1

(12) United States Patent
Stephens

(10) Patent No.: US 10,214,023 B1
(45) Date of Patent: Feb. 26, 2019

(54) FLUID DESIGN FOR RECIRCULATION WITHIN HIGH PACKING DENSITY INKJET PRINT HEADS

(71) Applicant: XEROX CORPORATION, Norwalk, CT (US)

(72) Inventor: Terrance L. Stephens, Canby, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/690,579

(22) Filed: Aug. 30, 2017

(51) Int. Cl.
*B41J 2/18* (2006.01)
*B41J 2/14* (2006.01)

(52) U.S. Cl.
CPC ..... *B41J 2/18* (2013.01); *B41J 2/1433* (2013.01); *B41J 2002/14419* (2013.01)

(58) Field of Classification Search
None
See application file for complete search history.

(56) References Cited

U.S. PATENT DOCUMENTS 7,222,937 B2 5/2007 Brookfield et al.
7,857,432 B2 12/2010 Stephens et al.
9,694,582 B1 7/2017 Stephens et al.
2002/0186270 A1 12/2002 Sharma
2010/0220146 A1 9/2010 Menzel
2011/0128335 A1 6/2011 von Essen et al.
2015/0191021 A1* 7/2015 Komatsu ..... B41J 2/17566 347/7

FOREIGN PATENT DOCUMENTS

JP 56075867 A * 6/1981 ..... B41J 2/16508

OTHER PUBLICATIONS

IP.com search.*
IP.com search (Year: 2018).*

* cited by examiner

*Primary Examiner* — Lisa Solomon
(74) *Attorney, Agent, or Firm* — Miller Nash Graham and Dunn

(57) ABSTRACT

A print head has an ink source to supply and receive ink, a first channel to receive ink from the ink source, a second channel to return ink to the ink source, and a manifold structure connected to the two channels to receive ink from the first channel and return ink to the second channel. A method of operating a print head includes providing ink from an ink source at a first pressure through a first channel, routing the ink through an inlet port of at least one single jet, moving the ink through the single jet to an outlet port of the single jet, routing the ink from the outlet port of the single jet, directing the ink to a second channel, and returning ink through the second channel to the ink source at a second pressure.

13 Claims, 11 Drawing Sheets

FLUID DESIGN FOR RECIRCULATION WITHIN HIGH PACKING DENSITY INKJET PRINT HEADS

TECHNICAL FIELD

This disclosure relates to inkjet print heads, and more particularly to inkjet print heads having packing densities of 300 NPI or greater.

BACKGROUND

In order to jet high pigment loaded inks, as well as improve jetting latency and robustness in general, it is desirable to have continuous flow, or recirculation of ink through inkjet print heads.

Typical schemes for enabling recirculation through print heads involve ink return or recirculation paths in addition to the primary ink supply paths within the print head. This, in turn, can negatively impact the single jet performance, jet packing density and waterfront, as well as increase the overall complexity of the print head fluidic structure. One such example of this approach to print head recirculation is described in U.S. Pat. No. 9,694,582.

The current embodiments enable continuous flow, or recirculation of ink through a print head, including the single jets, without the need for additional ink manifold structure beyond the already existent ink supply structure.

SUMMARY

An embodiment is a print head that has an ink source, the ink source to supply and receive ink, a first channel connected to the ink source to receive ink from the ink source, a second channel connected to the ink source to return ink to the ink source, and a manifold structure disposed between and connected to the two channels to receive ink from the first channel and return ink to the second channel.

An embodiment is a method of operating a print head that includes providing ink from an ink source at a first pressure to at least one finger manifold through a first channel, routing the ink through an inlet port of at least one single jet connected to the finger manifold, moving the ink through the single jet to an outlet port of the single jet connected to the finger manifold, routing the ink from the outlet port of the single jet back into the finger manifold, directing the ink from the finger manifold to a second channel, and returning ink through the second channel to the ink source at a second pressure.

DETAILED DESCRIPTION OF THE EMBODIMENTS

The term "ink" as used herein refers to any material that is liquid when applied to an object that is intended to receive the ink. Some examples of different types of inks include aqueous inks, oil based inks, solvent based inks, UV curable inks, heated phase change inks, etc.

The term "print head" as used herein refers to a component of a printing or marking system that is configured to eject ink drops onto an object that is intended to receive the ink drops. A typical print head includes a plurality of single jets that are configured to eject the ink drops. The single jets are typically arranged into an array of single jets, the array containing one or more rows and/or columns of single jets.

Figure 1:
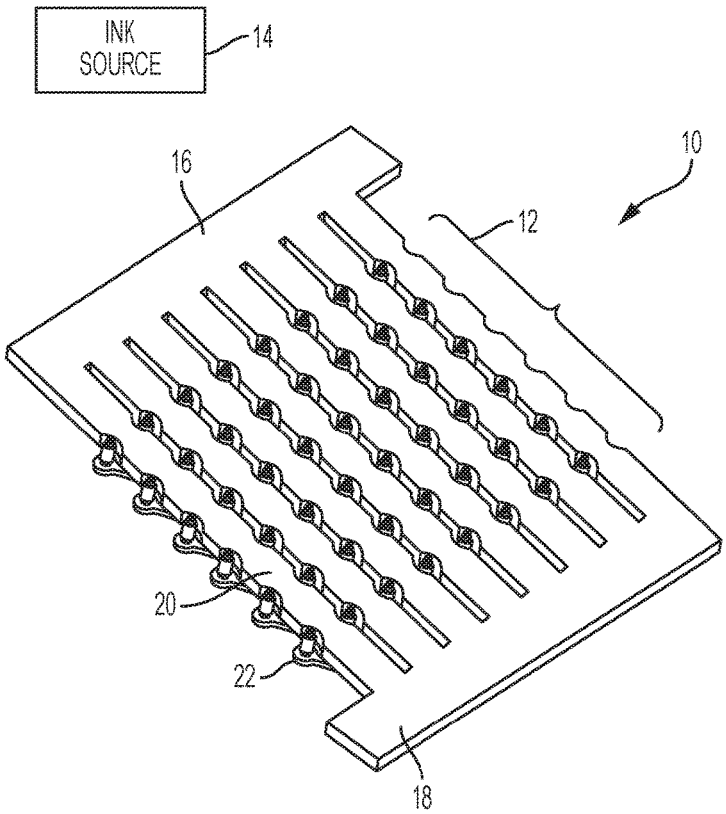
FIG. 1 shows a prior art embodiment of a print head manifold and single jet structure that does not use recirculation.
Figure 2:
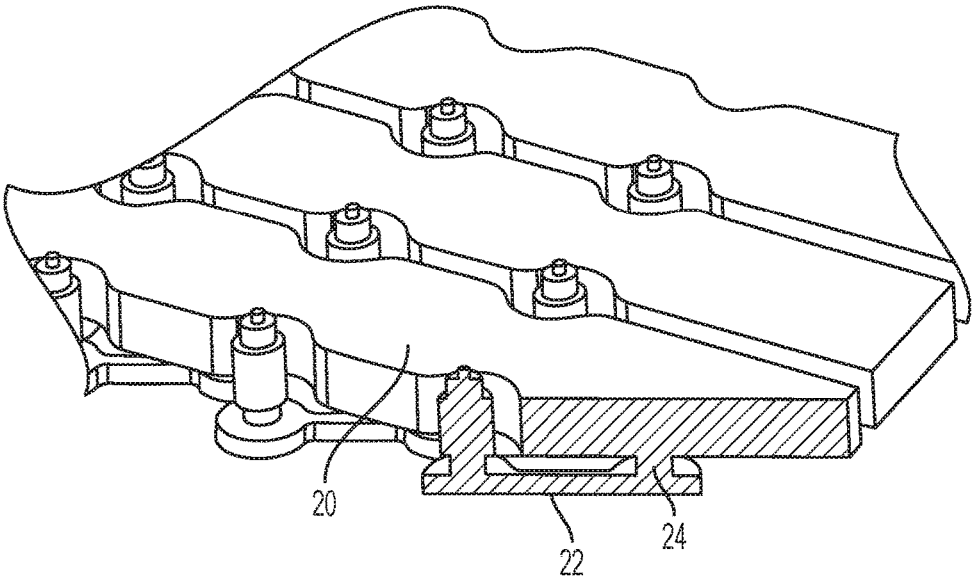
FIG. 2 shows a partial cross section of a prior art embodiment of a manifold and single jet structure that does not use recirculation.
Figure 3:
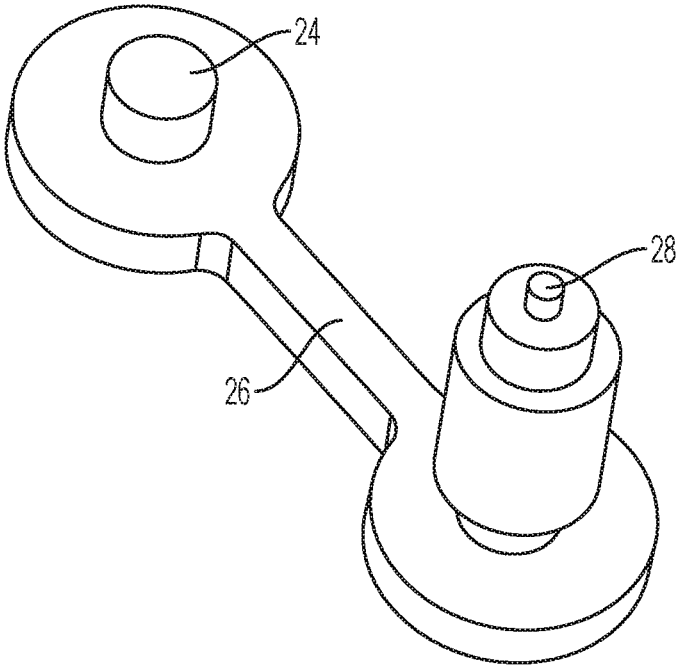
FIG. 3 shows a prior art embodiment of a single jet structure that does not use recirculation.

FIGS. 1 through 3 pertain to prior art embodiments of a print head fluidic design that generally does not make use of recirculation, and lacks the ability to provide recirculation through the single jet structure altogether. FIG. 1 shows a portion of a manifold structure 10 and single jet array 12 that is representative of a typical non-recirculation version of a high packing density inkjet print head. In the section of print head depicted in FIG. 1, an ink source 14 supplies ink to an upper channel 16 and lower channel 18. The channels supply ink to several finger manifolds such as 20, which in turn supply ink to several single jets such as 22 within an array of single jets.

FIG. 2 shows a partial cross-section of a finger manifold 20 and single jet 22 that does not allow recirculation through the single jet. Ink is supplied to the single jet from the finger manifold through a single jet inlet port 24.

FIG. 3 shows a view of a single jet typical of a design that does not allow recirculation through the single jet. The inlet port 24 receives ink from a finger manifold as described in FIG. 2. When the single jet is activated, ink flows into the inlet port 24, through the single jet channel 26, and exits the single jet through an aperture or nozzle 28. During normal operation, ink only flows through the single jet while the jet is being activated, and remains quiescent between the inlet port 24 and the aperture 28 during non-jetting periods.

The following embodiments make use of the pressure drop inherently available within an already existing ink supply path to drive recirculation within the print head; and in particular, to drive recirculation through the individual jets within the print head without the need for additional ink return or recirculation paths.

Figure 4:
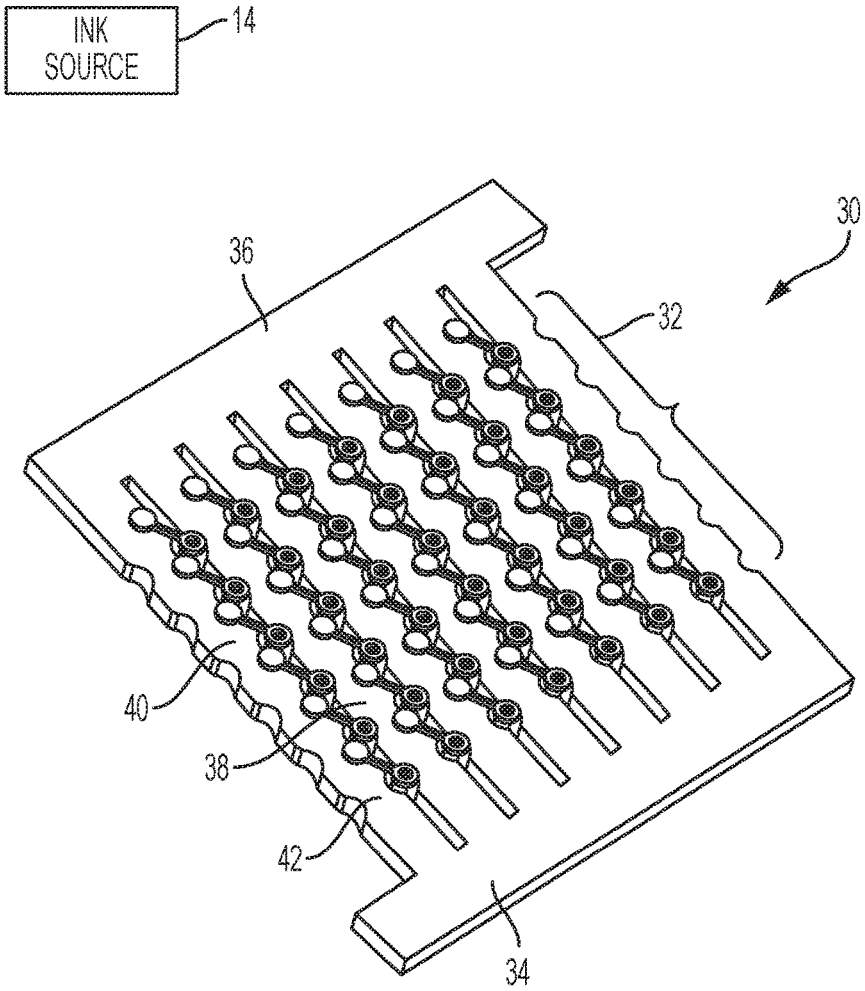
FIG. 4 shows an embodiment of a print head manifold and single jet structure that uses recirculation.

FIGS. 4 through 12 pertain to embodiments of a print head design that does make use of recirculation, and especially possesses the ability to provide recirculation through the single jet structure. FIG. 4 shows a portion of a manifold structure 30 and single jet array 32 that is representative of a high packing density inkjet print head having the ability to provide recirculation.

In the section of print head of the embodiment shown in FIG. 4, an ink source 14 is able to supply ink to a lower channel 34 and receive ink from an upper channel 36. The lower channel is able to supply ink to several finger manifolds such as 38 and 40, which in turn can supply ink to several single jets such as 42 within an array of single jets. In addition to being able to supply ink to the array of single jets, the finger manifolds can also supply ink to the upper channel 36.

Figure 5:
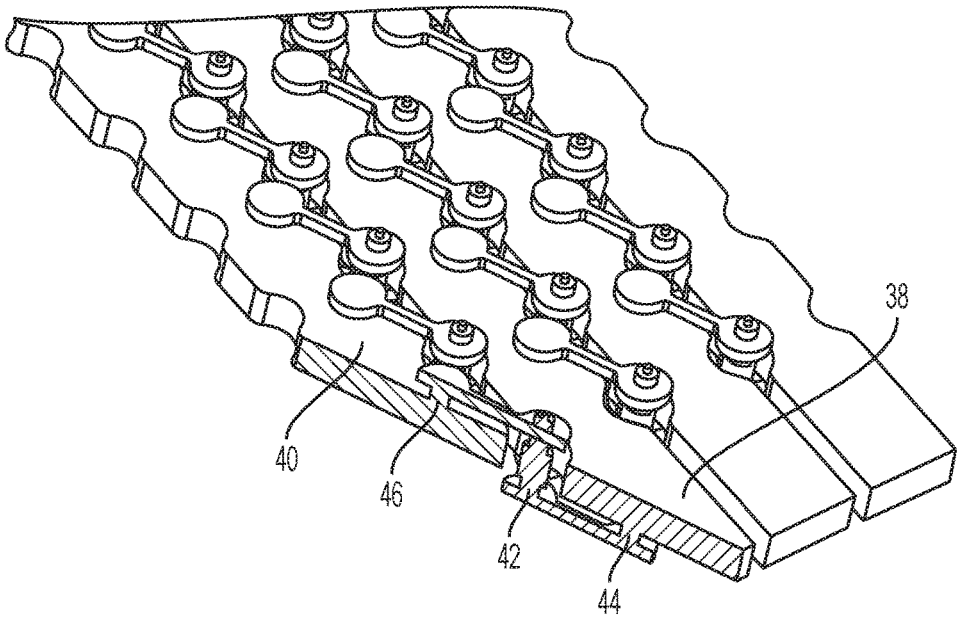
FIG. 5 shows a partial cross section of an embodiment of a manifold and single jet structure that uses recirculation.

FIG. 5 shows a partial cross-section of finger manifolds 38 and 40 and single jet 42 that allow recirculation through the single jet. The single jet is able to receive ink from a finger manifold such as 38 through a single jet inlet port 44. Unlike architectures previously discussed, each single jet 42 also has a single jet exit port 46 that is able to return ink to a finger manifold such as 40. Once returned to the finger manifold, the ink is able to flow along the length of the finger manifold where it can supply ink to additional single jets within the array of single jets, supply ink to the upper channel 36 and eventually return to the ink source 14.

Figure 6:
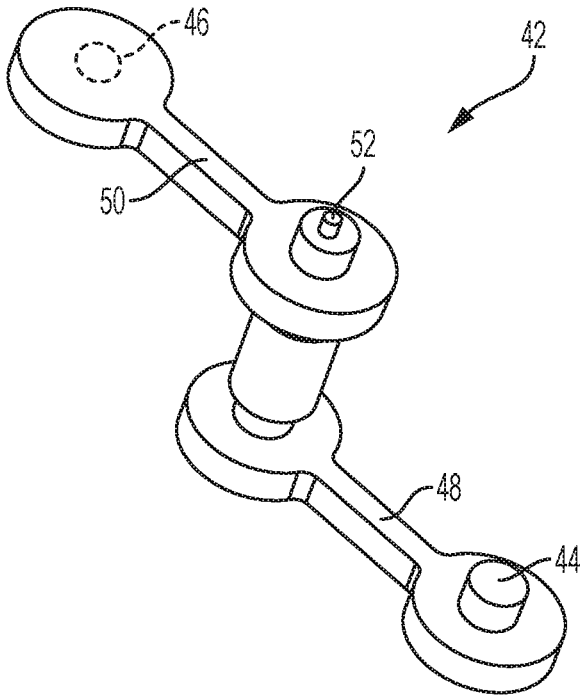
FIG. 6 shows an embodiment of a single jet structure that uses recirculation.

FIG. 6 shows a single jet typical of a design that allows recirculation through the single jet. The inlet port 44 is able to receive ink from a finger manifold as described in FIG. 5. When the single jet is not activated, ink can flow into the single jet inlet port 44, through the entrance channel 48, through the exit channel 50, out the exit port 46, and into a finger manifold. When the single jet is activated, ink can continue to flow in this manner, however a portion of the ink will also be caused to eject from the single jet through an aperture or nozzle 52. One should note that the manifold structure of the recirculation design is substantially similar to that of the non-recirculation design.

Figure 7:
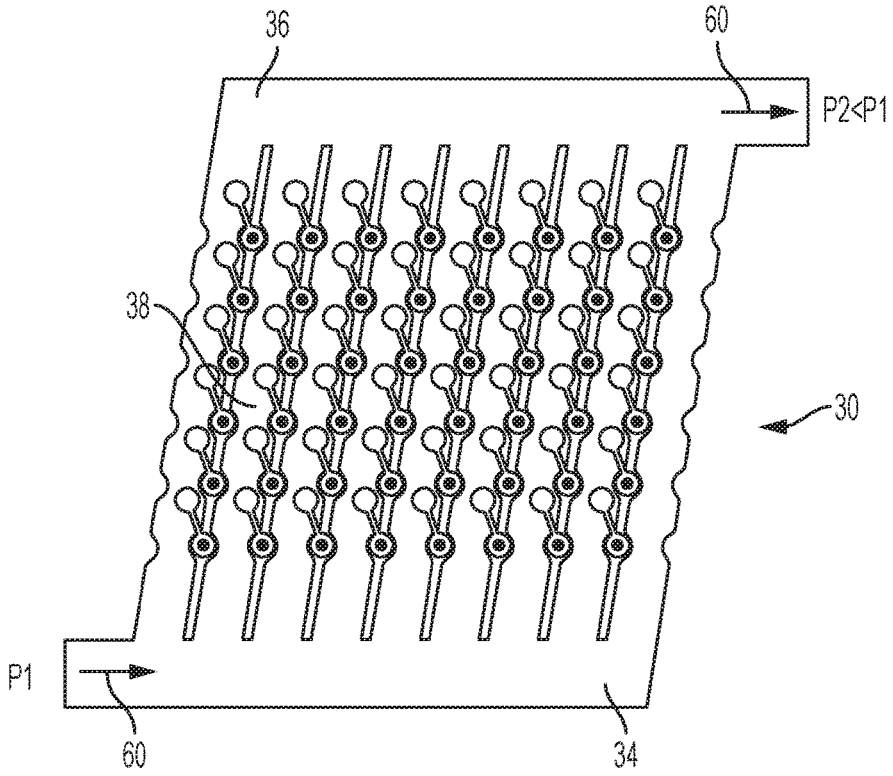
FIG. 7 shows the fluid flow path within a portion of a manifold structure of an embodiment of a print head that uses recirculation.

As shown by arrows 60 in FIG. 7, continuous flow through the manifold structure 30 can be achieved by applying a pressure differential between the entrance of lower channel 34 and the exit of upper channel 36. With proper sizing, the pressure drop along the length of each channel will be small, and most of the pressure drop will happen along the length of the finger manifolds. Given this, all finger manifolds such as 38 will have substantially similar flow rates. One should also note that the direction of flow may be reversed by reversing the relative pressures applied at the entrance and exit of the lower and upper channels.

Figure 8:
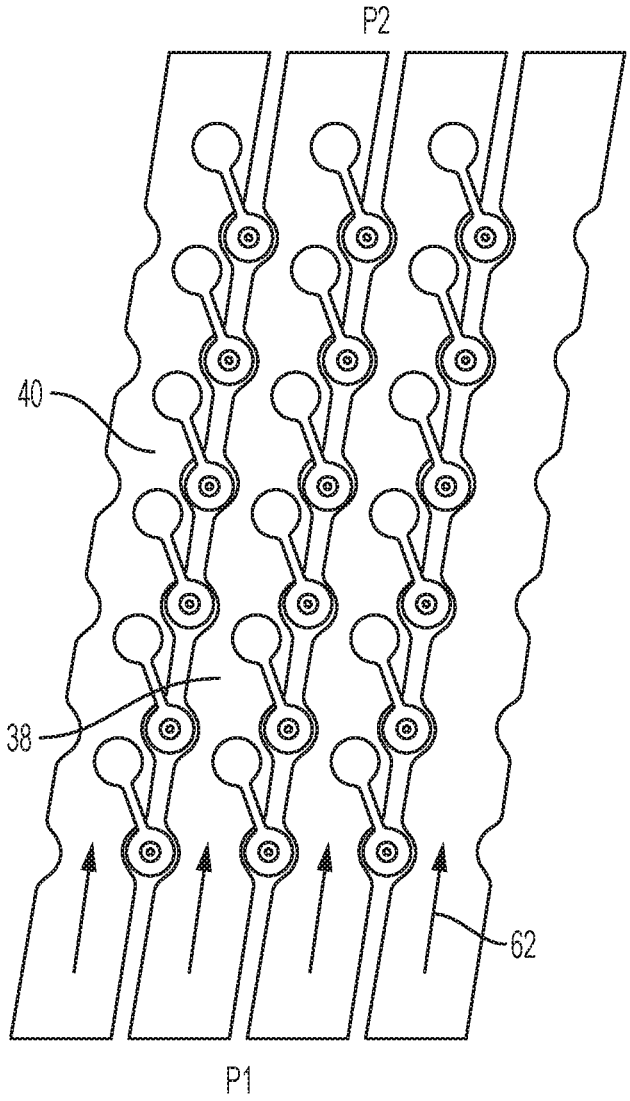
FIG. 8 shows the flow path within a portion of finger manifolds of an embodiment of a print head that uses recirculation.

As shown by arrows 62 in FIG. 8, continuous flow through the finger manifolds, such as 38 and 40, will also take place due to the pressure differential. This results in a continuous pressure gradient along the length of the finger manifolds. To generate flow through each single jet within the array of single jets without the need for additional manifold structure, the embodiments here make use of the differential pressure that each single jet experiences due to the pressure gradient along the length of the finger manifold structure, and not the absolute pressure differential between individual finger manifolds. In this manner, each single jet within the array of single jets behaves as a fluid path that runs in parallel with its immediate supply manifold structure, and not perpendicular to its immediate supply and return manifold structures.

Figure 9:
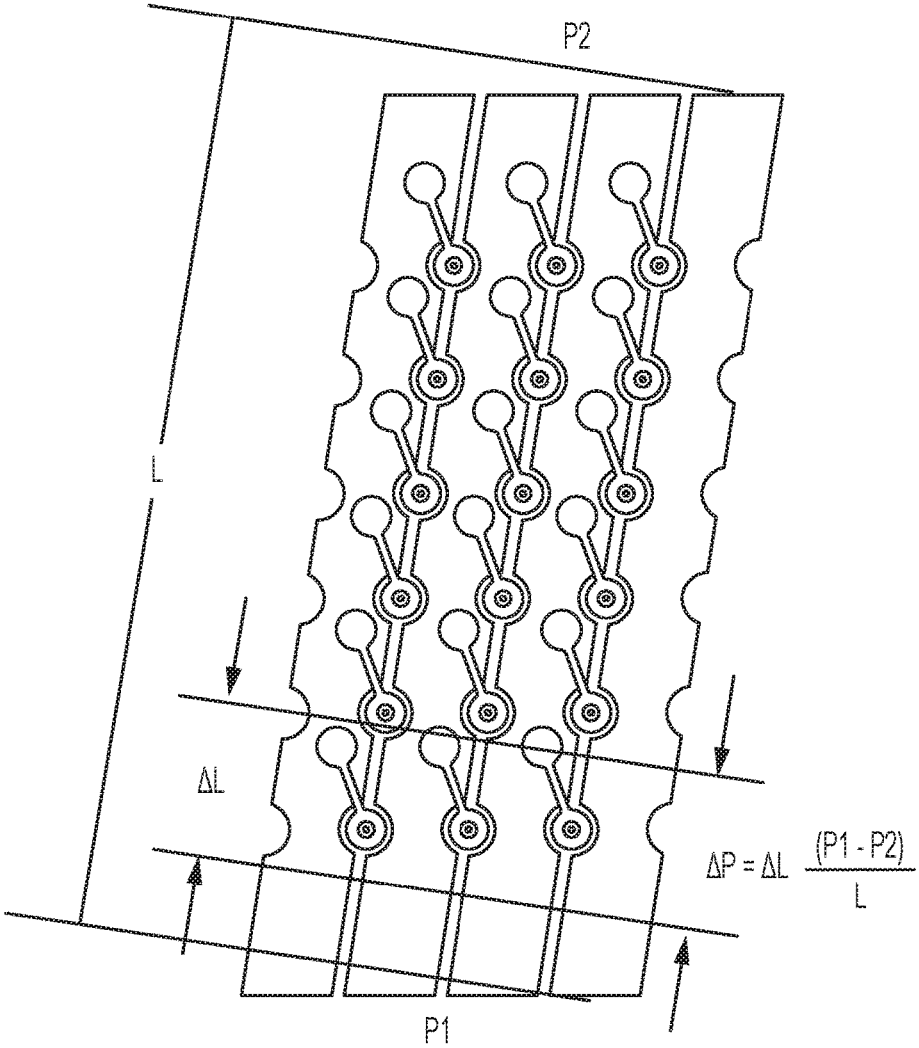
FIGS. 9 and 10 describe how a pressure differential intended to drive flow through a single jet of an embodiment of a print head that uses recirculation is developed.
Figure 10:
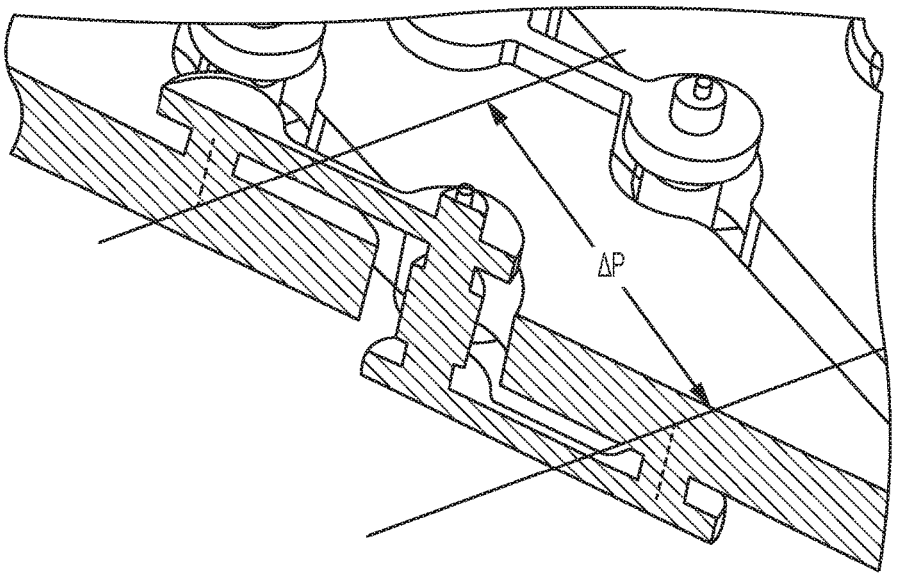

As shown in FIGS. 9 and 10, the pressure differential between the entrance and exit ports of each single jet is equivalent to the pressure drop per unit length of finger manifold multiplied by the distance between the entrance and exit ports of each single jet as projected in a parallel manner upon the finger manifold.

Figure 11:
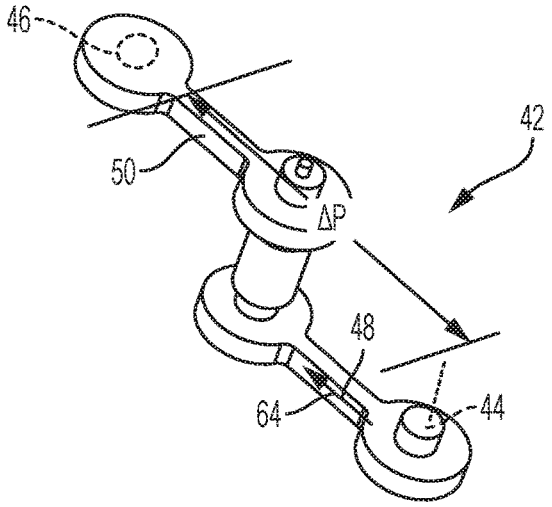
FIG. 11 shows the flow within a single jet of an embodiment of a print head that uses recirculation.
Figure 12:
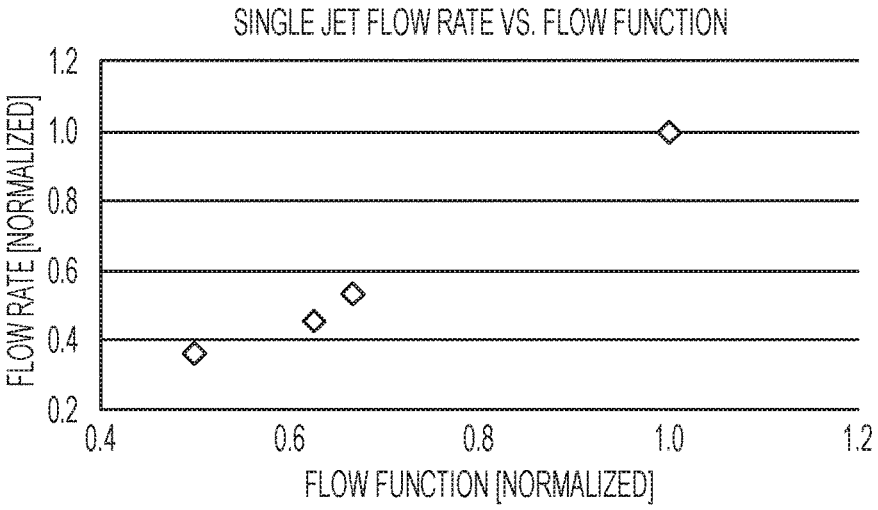
FIG. 12 shows a graph of flow rate versus flow function for a single jet of an embodiment of a print head that uses recirculation.

Arrow 64 of FIG. 11 depicts the flow that will occur through each single jet, such as 42, as a result of the pressure differential between the entrance port 44 and exit port 46 of each single jet. The flow rate through each single jet will be proportional to the pressure differential between the single jet entrance and exit ports, and inversely proportional to the single jet resistance between the two ports:

$$\text{Flow} \propto \frac{\Delta P}{R} \cong \left(\frac{dP}{dL}\right)\left(\frac{L_1 + L_2}{R_1 + R_2}\right) = \text{Flow Function}$$

Where $L_1$ and $R_1$ are the length and resistance of the inlet channel 48 and $L_2$ and $R_2$ are the length and resistance of the exit channel 50. As such, the flow rate through the single jets can be tailored by adjusting the pressure gradient, as well as lengths and cross-sections of the inlet and exit channels. This is shown with CFD results in FIG. 12.

With this method, it is possible to enact continuous recirculation of ink through a print head, including the single jets within the print head single jet array, without the need for additional ink manifold structure beyond the already existent ink supply structure.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A print head, comprising:

an ink source, the ink source to supply and receive ink;

a first channel connected to the ink source to receive ink from the ink source;

a second channel connected to the ink source to return ink to the ink source, wherein the first and second channels have a pressure differential; and a manifold structure disposed between and connected to the two channels to receive ink from the first channel and return ink to the second channel.

2. The print head of claim 1, wherein an array of single jets is connected to the manifold structure, each single jet within the array having an inlet port, exit port, and nozzle.

3. The print head of claim 2, wherein each single jet is arranged to receive ink from the manifold structure through the jet inlet port, return ink to the manifold structure through the jet exit port, and to dispense ink through the jet nozzle.

4. The print head of claim 2, wherein a fluid path through each single jet operates in parallel with a fluid path of the manifold structure to which each single jet is connected.

5. The print head of claim 1, wherein the pressure differential between the first and second channels results in a pressure gradient along the length of the manifold structure, the pressure gradient causing flow along the manifold structure.

6. The print head of claim 5, wherein the pressure gradient along the length of the manifold structure results in a second pressure differential between a single jet inlet port and outlet port.

7. The print head of claim 6, wherein the second pressure differential is equivalent to a pressure drop per unit length of the manifold structure multiplied by the distance between each single jet inlet port and outlet port.

8. The print head of claim 6, wherein the second pressure differential results in flow through each single jet, the flow acting in parallel to a flow within the manifold structure.

9. A method of operating a print head, comprising:

providing ink from an ink source at a first pressure to at least one finger manifold through a first channel;

routing the ink through an inlet port of at least one single jet connected to the at least one finger manifold;

moving the ink through the at least one single jet to an outlet port of the at least one single jet connected to the at least one finger manifold;

routing the ink from the outlet port of the at least one single jet back into the at least one finger manifold;

directing the ink from the at least one finger manifold to a second channel; and returning ink through the second channel to the ink source at a second pressure.

10. The method of claim 9, wherein a difference between the first and second pressures causes a continuous flow through the finger manifold.

11. The method of claim 9, wherein a difference between the first and second pressures causes a pressure gradient along the length of the at least one finger manifold.

12. The method of claim 11, wherein the pressure gradient causes a pressure differential equivalent to a pressure drop per unit length of the at least one finger manifold multiplied by a distance between the inlet port and the outlet port of the at least one single jet, the distance being in parallel to the length of the at least one finger manifold.

13. The method of claim 12, wherein the pressure differential causes a continuous flow through the at least one single jet, the flow being proportional to the pressure differential, and inversely proportional to a fluidic resistance of the at least one single jet, the flow acting in parallel to a flow in the at least one finger manifold.

* * * * *